US006718591B2

(12) United States Patent
Marsh

(10) Patent No.: US 6,718,591 B2
(45) Date of Patent: Apr. 13, 2004

(54) CLEANING DEVICE

(76) Inventor: Colleen E. Marsh, 21 Misty La., Clark Summit, PA (US) 18411

( * ) Notice: Subject to any disclaimer, the term of this patent is extended or adjusted under 35 U.S.C. 154(b) by 0 days.

(21) Appl. No.: 10/083,421

(22) Filed: Feb. 27, 2002

(65) Prior Publication Data

US 2003/0159227 A1 Aug. 28, 2003

(51) Int. Cl.[7] ..... A47L 13/12; A47L 13/46
(52) U.S. Cl. ..... 15/244.3; 15/229.13; 15/244.1
(58) Field of Search ..... 15/211, 229.11, 15/229.12, 229.13, 244.3, 244.1

(56) References Cited

U.S. PATENT DOCUMENTS 1,689,207 A * 10/1928 Kingman
2,140,578 A 12/1938 Goodloe
2,152,697 A 4/1939 Kingman
2,891,270 A 6/1959 Reiter
2,983,944 A 5/1961 Uselis
3,337,893 A 8/1967 Fine et al.
3,798,700 A 3/1974 Popiel
5,336,330 A * 8/1994 Shumway et al.
5,787,542 A * 8/1998 Chien
6,038,727 A * 3/2000 Chen

* cited by examiner

*Primary Examiner*—Randall Chin

(57) ABSTRACT

A cleaning device with a liquid absorbing member mounted on a handle, with two layers of netting over the sponge, each layer of netting having a node of netting internally situated and the two nodes of netting being located over one another at the center point of the end of the liquid absorbing member opposite from the handle, the netting being secured on the handle adjacent the liquid absorbing member, the nets and their nodes being able to move in relation to one another and to the liquid absorbing member.

10 Claims, 3 Drawing Sheets

CLEANING DEVICE

BACKGROUND OF THE INVENTION

1. Field of the Invention

This invention relates to a cleaning device and more particularly to a cleaning device using a liquid absorbing member which is most likely either a natural or artificial sponge, preferably mounted on a handle, with two layers of netting for abrasion for abrasion located over the liquid absorbing member, each layer of netting having a node internally mounted in it, the nodes and the netting interacting with one another and the liquid absorbing member to clean in crevices and corners, the netting being secured to the handle adjacent the liquid absorbing member.

2. Description of the Prior Art

Numerous devices for scrubbing and cleaning are known. Sponges, and more particularly cellulose sponges, have been used for sometime to clean. Sponges are well known to be very absorbent of liquids. Such liquid absorbent materials are beneficial for cleaning in that they hold liquid for cleaning and permit the transfer of liquid from a liquid source to the object being cleaned. Abrasive cleaners are also known such as metal wool pads and netting pads which have abrasive qualities quite beneficial to cleaning. However, such abrasive materials have at best limited or no liquid retention qualities.

Various combinations have been achieved of liquid absorbing materials and abrasive materials to provide both the advantages of having the required liquid and the abrasive action together.

The Popeil patent, U.S. Pat. No. 3,798,700, teaches a replaceable wringer mop head formed from a singe piece of cellular sponge with a reinforcing mesh close to but not at the exterior surface to reinforce the surface and thereby inhibit tearing.

The Fine patent, U.S. Pat. No. 3,337,893, teaches a tooth brush of the generally accepted design but having a soft pad covered by mesh on the back side of the handle opposite the bristles.

The Uselis patent, U.S. Pat. No. 2,983,944, teaches the optional use of a scrub net over a sponge for abrasive means to provide an effective cleaning tool.

The Donney patent, U.S. Pat. No. 2,958,885, teaches a sponge with two different covers on it. The inner cover is a fine mesh for regulating the outflow of liquid form the sponge and to prevent food particles from entering the sponge. An aperture is provided in the mesh to inject sterilizing fluid into the sponge. Over the mesh, an outer scouring material is added to provide abrasion but which does not limit flow in or out of the sponge as does the mesh beneath it.

The Reiter patent, U.S. Pat. No. 2,891,270 teaches a single layer of net over a sponge which serves not only for abrasive action but also to wring out the sponge.

The Kingman patent U.S. Pat. No. 2,152,697 teaches a single layer of mesh over a core of liquid absorbing material but the single layer of mesh is part hard and non-absorbent and also part soft and absorbent.

The Goodloe patent, U.S. Pat. No. 2,140,578, teaches a single layer of metallic mesh over a brush to add abrasive action.

The Clark patent, U.S. Pat. No. 1,933,893, teaches a shoe polish dispenser using multiple layers of gauze which is absorbent to polish shoes.

The Cornell patent, U.S. Pat. No. 1,529,690, teaches a hard non-absorbent base and handle covered with a metallic net to provide abrasive cleaning without liquid retention.

OBJECTS OF THE INVENTION

None of the patents referred to above show a node of mesh secured on liquid absorbing material and held in place by a layer of mesh and thus also does not teach two nodes, one above the other and interacting together. Although multiple layers of different materials are shown, two layers of non-absorbent netting, one over the other is not shown.

Accordingly, it is an object of the present invention to provide a cleaning tool which has abrasive qualities and also is liquid absorbing.

Accordingly, it is another object of the present invention to provide a cleaning tool which can readily conform to the shape of grooves and corners to be cleaned.

Accordingly, it is another object of the present invention to provide a cleaning tool which is economical to construct and durable.

Other objects and advantages of the present invention will become apparent to those of ordinary skill in the art as the description thereof proceeds.

SUMMARY OF THE INVENTION

A cleaning device is provided which can clean in corners and grooves efficiently by combining the benefits of a liquid absorbing member and an abrasive netting which can most effectively conform to a space to be cleaned. A liquid absorbing body, preferably with a circular cross section is covered with an inner layer of netting which is non-absorbent and flexible while also being abrasive. A node of netting, preferably formed from its own respective layer of netting, is located inside the layer of netting centrally on the outer end of the liquid absorbing material. A second layer of netting is placed over the initial layer of netting. The second layer of netting also has an node of netting formed inside the layer of netting and which rests on the first layer of netting over the first node. Both layers of netting are secured over the liquid absorbing member, preferably on a handle which is secured to the liquid absorbing material at the end opposite from where the two nodes are located. The two layers of netting and the nodes may move in relationship to one another and to the liquid absorbing member.

DESCRIPTION OF THE DRAWINGS

The invention may be more readily understood by referring to the accompanying drawings, in which.

DESCRIPTION OF THE NUMERALS

| NUMERAL | DESCRIPTION |
|---|---|
| 11 | Liquid Absorbing Member |
| 13 | Handle |
| 15 | Inner End of Liquid Absorbing Member |
| 17 | Outer End of Liquid Absorbing Member |
| 19 | Grooves in Liquid Absorbing Member |
| 21 | Outside Surface of liquid Absorbing Member |
| 23 | Two Nets |
| 25 | Inner Net |
| 27 | Outer Net |
| 29 | Closed End of both Nets |
| 31 | Open End of Both Nets |
| 33 | Nodes on both Nets |

DESCRIPTION OF THE PREFERRED EMBODIMENT

Figure 1:
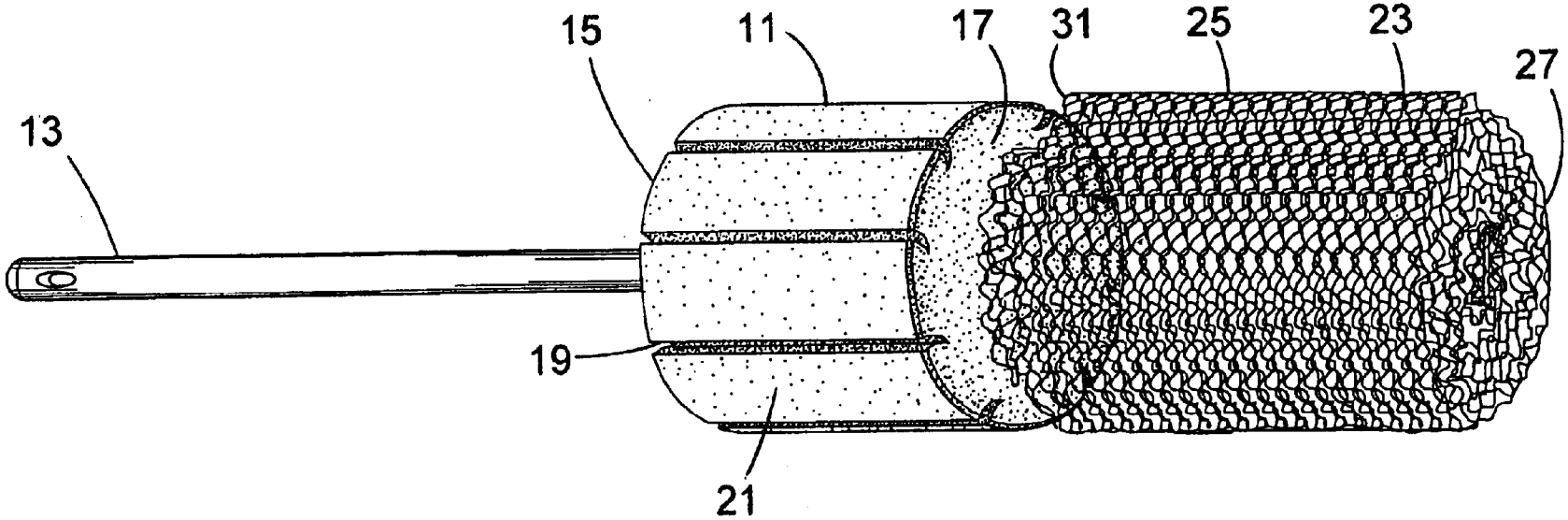
FIG. 1 is an exploded view of the cleaning device showing only the inner net removed from the liquid absorbing member which is shown mounted on a handle.
Figure 2:
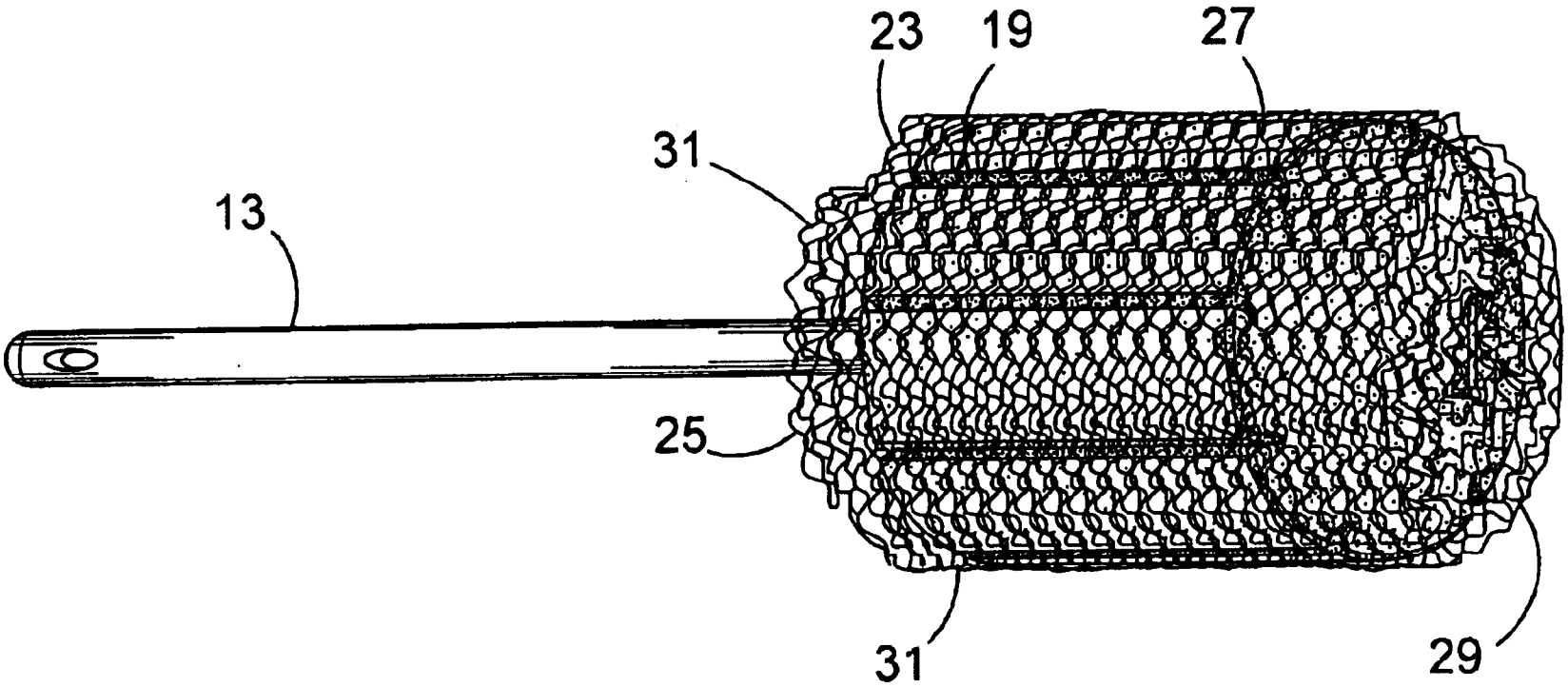
FIG. 2 is a pictorial view of the cleaning device showing both layers of netting, each with its respective node mounted on the liquid absorbing member and secured to the handle.
Figure 3:
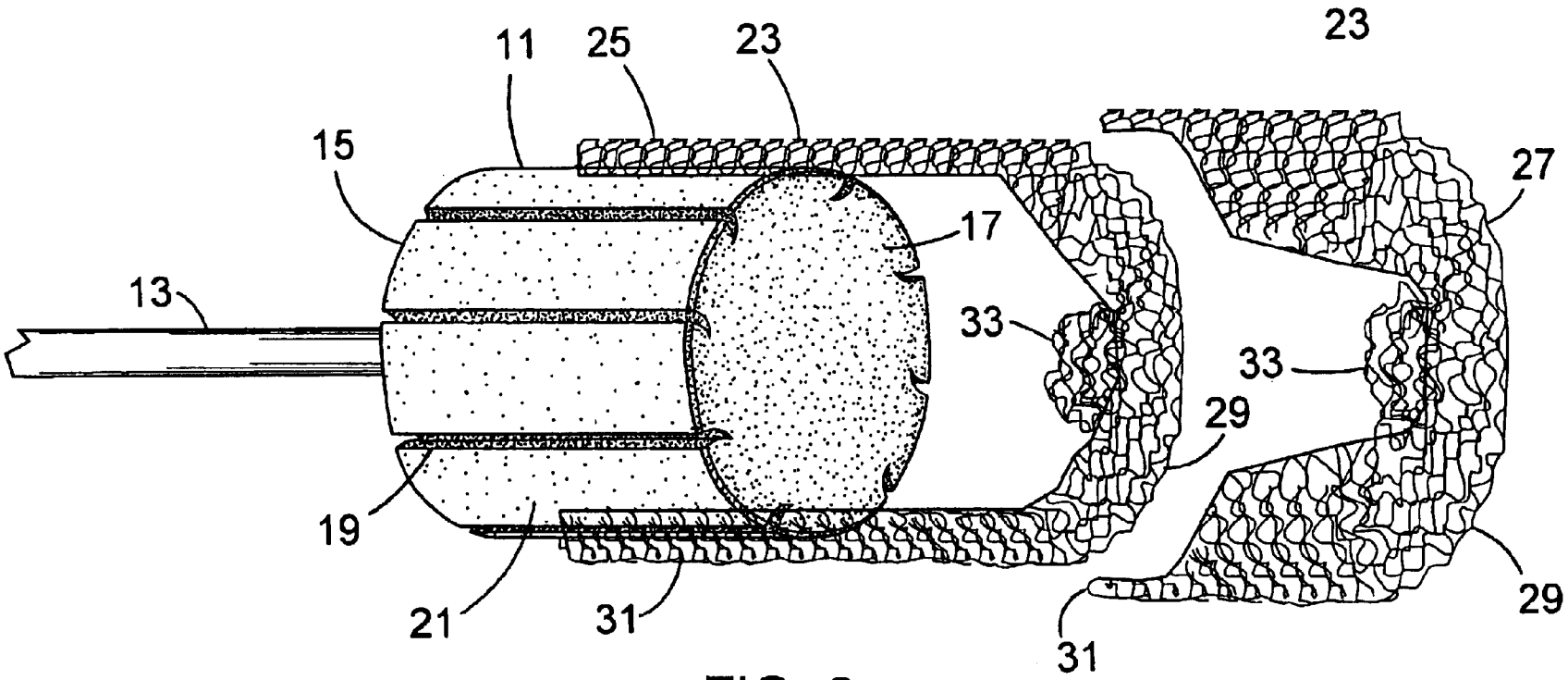
FIG. 3 is an exploded view, cut away, showing the nodes of both the inner netting and the outer netting while also showing the liquid absorbing member mounted on the handle.

Referring now to FIG. 1, a liquid absorbing member 11, most likely a sponge or a cellulose sponge, is shown mounted on a handle 13. The liquid absorbing member 11 is cylindrical, having both an inner end 15 and an outer end 17. The outer end 17 may be rounded to provide the flexibility to enter restricted crevices and corners but may also be flat as shown in FIG. 1. The inner end 15 is flat but may be any convenient shape since the inner end 15 is not the working end. Grooves 19 are formed in the liquid retaining member 11 and the grooves 19 are equally spaced about the outside surface 21 of the liquid absorbing member 11. The grooves 19 extend longitudinally from the inner end 15 to the outer end 17. The grooves 19 are optional but do provide greater ease of compression of the liquid absorbing member 11 to force the liquid absorbing member 11 into corners and crevices.

The handle 13 is mounted on the liquid absorbing member 11 generally at the center point of the inner end 15 and the handle 13 is aligned with the liquid absorbing member 11. The handle 13 is secured to the liquid absorbing member 11 by any convenient means but preferably the handle 13 is placed into an opening (not shown) in the liquid absorbing member 11 and is retained in place by any suitable adhesive. The handle 13 may be of varying lengths.

There are two nets 23 placed over the liquid absorbing member 11. Each of the two nets 23, namely the inner net 25 and the outer net 27 are constructed in the same manner. Each of the two nets 23 is generally a tube of netting having one closed end 29 and one open end 31. Each of the two nets 23 has a circular cross section so as to fit securely over the cylindrical shape of the liquid absorbing member 11.

The structure of the two nets 23 is best understood by a description of a preferable manner of forming the nets 23, although other methods may be used for forming the nets 23. To start, a tube of netting is required having the appropriate size to fit easily yet snugly over the liquid absorbing member 11. At one end, ultimately the closed end 29, the tube of netting is pulled together and at the center point of the tube of netting is bunched up into a node 33. The netting is tied to retain the node 33 so created. Obviously, for ease of production, the node 33 is formed on the outside of the tube of netting.

The final product is a tube of netting with node 33 located centrally on the inside of the closed end 29. This is easily achieved by turning the tube of netting inside out once the node 33 is formed as previously described.

Once both nets 23 are formed, the inner net 25 is fitted over the liquid absorbing member 11. The node 33 of the inner net 25 is located against the liquid absorbing member 11 generally at the center point of the outer end 17. The inner net 25 is retained about the liquid absorbing member 11 as a result of being secured on the handle 13 by tying or by adhesive. The inner net 25 is held against the liquid absorbing member 11 but can readily move in relation to the liquid absorbing member 11. The node 33 of the inner net 25 can move in relation to the liquid absorbing member 11 since the only point where the inner net 25 is secured is about the handle 13 adjacent the inner end 15 of the liquid absorbing member 11.

The outer net 27 is located over the inner net 25 and the node 33 of the outer net 27 is located against the inner net 25 at the node 33 of the inner net 25. The outer net 35 is also preferably secured to the handle 13 by tying or any other suitable means.

The outer net 35 and the node 33 of the outer net 35 can move within the confines resulting from being tied to the handle 13 in relation to the inner net 25 and to the liquid absorbing member 11. Likewise, the inner net 25 and the node 33 of the inner net 25, subject to the restriction of the inner net 25 being secured to the handle 13, may move in relation to the outer net 27 and the liquid absorbing member 11.

The result is that the liquid absorbing member 11, the inner net 25 and the outer net 27, are all retained together but are able to move in relationship to one another. In particular, the node 33 of the inner net 25 and the node 33 of the outer net 27 may move substantially independently of one another while still being held within their own general location in relationship to one another.

When cleaning in a corner or crevice, just a liquid absorbing member 11 can be compressed into the corner or crevice. Similarly, a single net on a liquid absorbing member 11 can be forced into a corner or crevice but with the two nodes 33 yielding to the space to be cleaned, superior cleaning is possible. With the handle 13 located at an acute angle to the space being cleaned, the liquid absorbing member 11 with the two nets 23 on it also enters the space with the two nodes 33 thereby providing the greatest flexibility for cleaning.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. A cleaning device comprising:

a liquid absorbing member having an inner end and an outer end;

a handle secured to the inner end of the liquid absorbing member and being generally aligned with the liquid absorbing member;

an inner layer of netting wrapped about the liquid absorbing member, the inner layer of netting including an inner node of netting within the inner layer of netting and secured to the inner layer of netting and being located against the outer end of the liquid absorbing member, the inner layer of netting being secured adjacent the inner end of the liquid absorbing member; and an outer layer of netting wrapped over the inner layer of netting including an outer node of netting within the outer layer of netting and secured to the outer layer of netting and being generally located at the outer end of the liquid absorbing member and against the inner node of the inner layer of netting, the outer layer of netting being held firmly against the inner layer of netting and being secured adjacent the inner end of the liquid absorbing member, the inner layer of netting and the outer layer of netting both being flexible and abrasive.

2. A cleaning device according to claim 1 wherein the liquid absorbing member is a sponge.

3. A cleaning device according to claim 1 wherein the liquid absorbing member is a cellulose sponge.

4. A cleaning device according to claim 1 wherein both the inner layer of netting and the outer layer of netting are secured to the handle adjacent the inner end of the liquid absorbing member.

5. A cleaning device according to claim 1 wherein the liquid absorbing member is cylindrical.

6. A cleaning device according to claim 1 wherein the outer end of the liquid absorbing member is rounded.

7. A cleaning device according to claim 1 wherein the liquid absorbing member is cylindrical and the outer end of the liquid absorbing member is rounded.

8. A cleaning device comprising:

a liquid absorbing member having an inner end and an outer end and further having a generally cylindrical shape, the outer end being generally rounded and the inner end being generally flat;

a handle secured to and generally centrally located at the inner end of the liquid absorbing member and being generally aligned with the liquid absorbing member;

an inner layer of netting wrapped about the liquid absorbing member, the inner layer of netting including an inner node of netting within the inner layer of netting and secured to the inner layer of netting and being located generally centrally on the outer end of the liquid absorbing member, the inner layer of netting extending from the outer end to the inner end of the liquid absorbing member; and an outer layer of netting wrapped over the inner layer of netting including an inner node of netting within the inner layer of netting and secured to the inner layer of netting and being generally located at the outer end of the liquid absorbing member and against the node of the inner layer of netting, the outer layer of netting being held firmly against the inner layer of netting being secured at the inner end of the liquid absorbing member.

9. A cleaning device according to claim 8 wherein the liquid absorbing member is a sponge.

10. A cleaning device comprising:

a cellulose sponge having an inner end and an outer end and further having a generally cylindrical shape, the inner end being generally flat;

a handle secured to and generally centrally located at the inner end of the cellulose sponge and being generally aligned with the cellulose sponge;

an inner layer of netting wrapped over the cellulose sponge, the inner layer of netting including an inner node of netting within the inner layer of netting and secured to the inner layer of netting and being located generally centrally on the outer end of the cellulose sponge from the outer end to the inner end of the cellulose sponge and being secured to the handle adjacent the inner end of the cellulose sponge; and an outer layer of netting wrapped over the inner layer of netting including an inner node of netting within the inner layer of netting and secured to the inner layer of netting and being generally located at the outer end of the cellulose sponge and against the node of the inner layer of netting, the outer layer of netting being held firmly against the inner layer of netting from the outer end of the cellulose sponge to the inner end of the cellulose sponge and being secured to the handle adjacent the inner end of the cellulose sponge.

* * * * *